US005598876A

United States Patent [19]

Zanini et al.

[11] Patent Number: 5,598,876

[45] Date of Patent: Feb. 4, 1997

[54] POWDERED MATERIAL DISPENSING UNIT

[75] Inventors: Gianpietro Zanini, Montanara; Carlo Corniani, Marmirolo, both of Italy

[73] Assignee: Azionaria Costruzioni Macchine Automatiche A.C.M.A. S.p.A., Bologna, Italy

[21] Appl. No.: 410,698

[22] Filed: Mar. 27, 1995

[30] Foreign Application Priority Data

Mar. 28, 1994 [IT] Italy ..... BO94A0133

[51] Int. Cl.[6] ..... B65B 1/04

[52] U.S. Cl. ..... 141/93; 141/59; 141/62; 141/65; 141/70; 141/67; 141/90; 141/145

[58] Field of Search ..... 141/48, 62, 63, 141/65, 59, 67, 89–93, 116, 126, 144, 145

[56] References Cited

U.S. PATENT DOCUMENTS

| | | | |
|---|---|---|---|
| 2,655,301 | 10/1953 | Riemer | 141/93 X |
| 3,195,586 | 7/1965 | Vogt | 141/67 X |
| 3,219,072 | 11/1965 | Lau | 141/93 X |
| 3,260,285 | 7/1966 | Vogt | 141/67 X |
| 3,334,666 | 8/1967 | Vogt | 141/59 X |
| 3,788,368 | 1/1974 | Geng et al. | 141/67 |
| 4,083,607 | 4/1978 | Mott | 141/90 X |
| 4,751,948 | 6/1988 | Hertig et al. | 141/67 |
| 4,974,646 | 12/1990 | Martin et al. | 141/67 |
| 5,275,215 | 1/1994 | Derby | 141/67 |

FOREIGN PATENT DOCUMENTS

| | | |
|---|---|---|
| 1091006 | 11/1967 | European Pat. Off. . |
| 774735 | 12/1934 | France . |

OTHER PUBLICATIONS

European Search Report dated Jul. 13, 1995 in European Application No. 94104154.0.

*Primary Examiner*—J. Casimer Jacyna

*Attorney, Agent, or Firm*—Christensen O'Connor Johnson & Kindness PLLC

[57] ABSTRACT

A gravity dispensing unit for filling containers with powdered material, wherein a vessel for powdered material presents, underneath, at least one dispenser with a central supply conduit in turn presenting a shutter and made of porous material; the supply conduit extending in fluidtight manner through an annular chamber for receiving pressurized fluid, and through an annular intake manifold surrounding the annular chamber and presenting an annular, downward-facing inlet.

9 Claims, 4 Drawing Sheets

51
52
42
43
44
45
46
47
48
55
49
56
34
54
68
40
39
31
50
92
33
91
80
32
82
81
83
89
11
88
90
38
62
3
30
36
37
76
58
79
35
77
78
84
60
85
41
57
73
74
75
87
59
61
71
72
67
66
69
64
70
2B
2A
65
86
63
10
2
5
29
3
6
7
11
28
9
26
8
27
14
13
12
4

POWDERED MATERIAL DISPENSING UNIT

BACKGROUND OF THE INVENTION

The present invention relates to a powdered material dispensing unit.

More specifically, the present invention relates to a dispensing unit of the above type, which may be used to advantage for filling containers.

SUMMARY OF THE INVENTION

It is an object of the present invention to provide a straightforward, reliable dispensing unit for continuously filling containers with powdered material, and which at the same time provides for minimizing material losses to the atmosphere during the filling operation.

According to the present invention, there is provided a powdered material dispensing unit for filling containers, the unit comprising a vessel for powdered material, and at least one dispenser connected to the bottom end of the vessel to permit measured quantities of said material to be withdrawn by gravity from the vessel; the dispenser comprising a supply conduit communicating with the vessel, and a device for selectively closing the supply conduit; characterized in that the supply conduit is made of porous material; the dispenser comprising a pneumatic circuit for feeding pressurized pneumatic fluid into contact with the outer surface of the supply conduit, and suction means adjacent to the output end of the supply conduit.

According to a preferred embodiment of the above dispensing unit, the pneumatic circuit comprises an annular chamber for receiving said pressurized pneumatic fluid; the supply conduit extending in fluidtight manner through the annular chamber.

Moreover, the suction means preferably comprise an annular intake manifold surrounding the supply conduit and presenting a downward-facing annular inlet.

BRIEF DESCRIPTION OF TEE DRAWINGS

A non-limiting embodiment of the present invention will be described by way of example with reference to the accompanying drawings, in which.

DETAILED DESCRIPTION OF THE INVENTION

Figure 1:
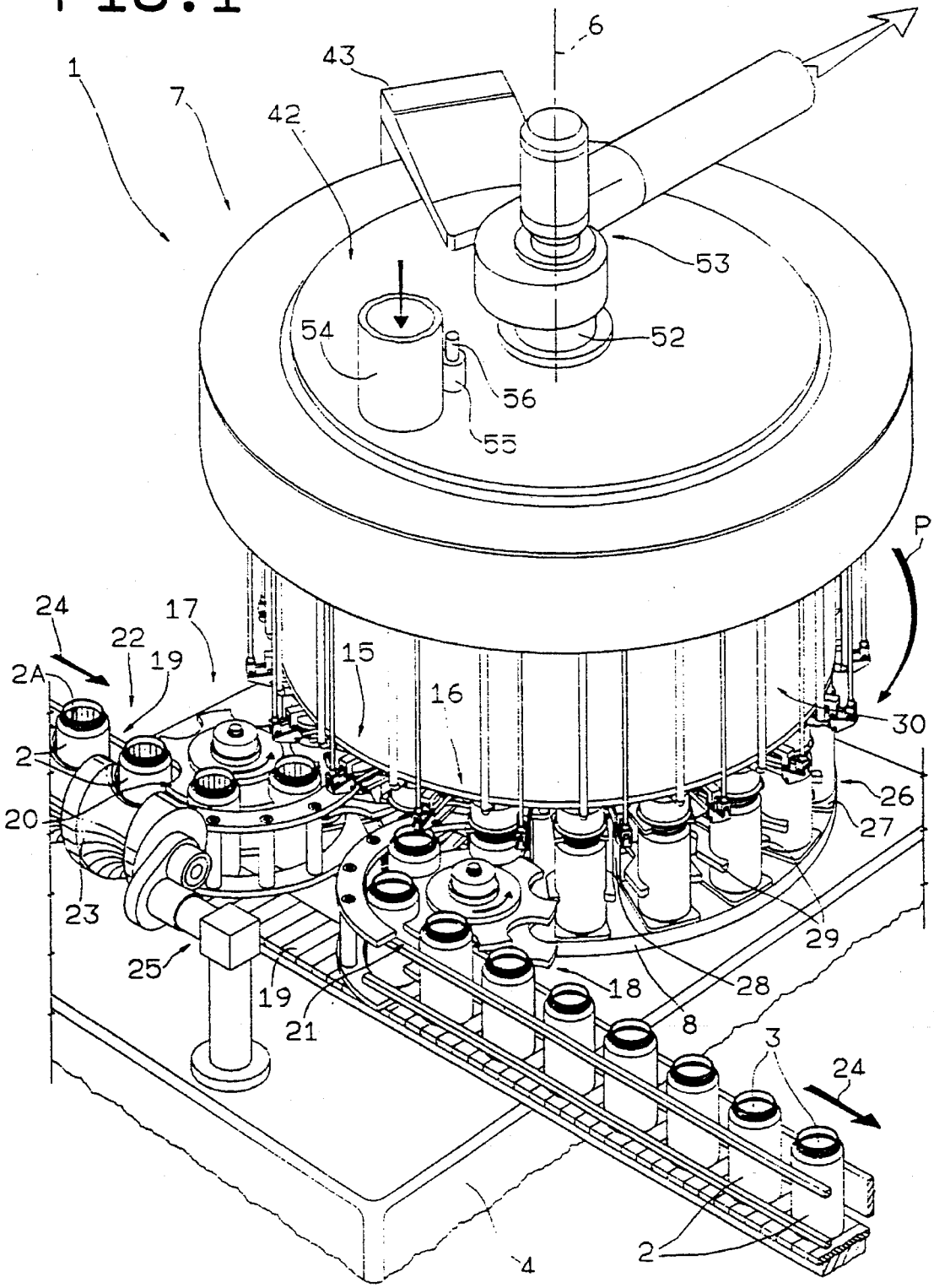
FIG. 1 shows a view in perspective of a preferred embodiment of the dispensing unit according to the present invention.
Figure 2:
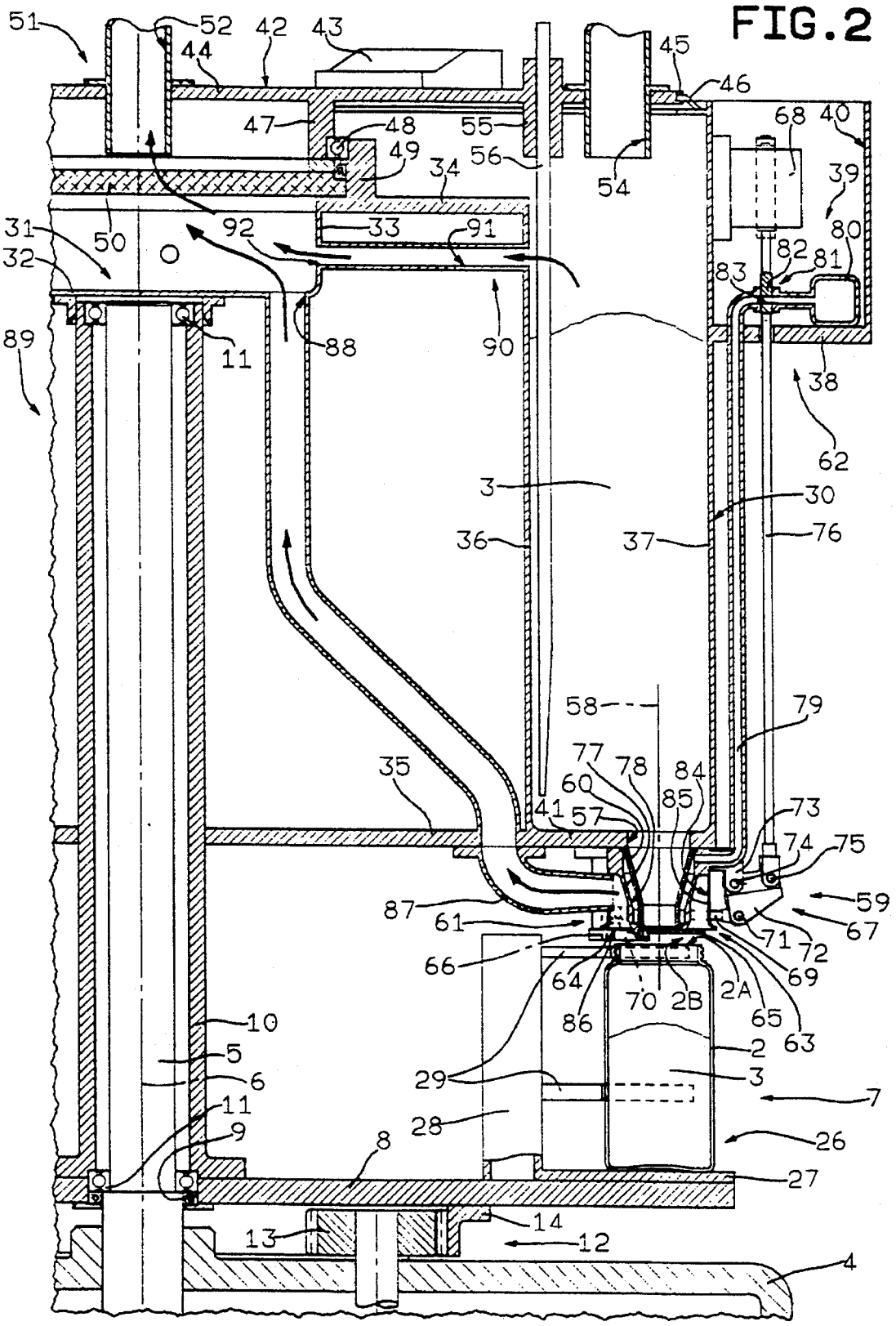
FIG. 2 shows a larger-scale axial section of part of the FIG. 1 dispensing unit.

Number 1 in FIG. 1 indicates a system for gravity filling a succession of containers 2, each presenting a top inlet 2A, with measured quantities of powdered material 3 (FIG. 2).

With reference to FIGS. 1 and 2, system 1 comprises a base 4 to which is fitted a fixed shaft 5 presenting a vertical axis 6 and supporting for rotation a carousel conveyor 7. Conveyor 7 comprises a horizontal annular plate 8 with a central through hole 9 fitted through with shaft 5; and a sleeve 10 integral with and extending upwards from plate 8 coaxially with axis 6, and connected to shaft 5 via the interposition of bearings 11.

Conveyor 7 is rotated clockwise (in FIG. 1) about axis 6 by a drive device 12 comprising a powered pinion 13, and a ring gear 14 projecting beneath plate 8 and meshing with pinion 13. As it rotates, plate 8 feeds containers 2 continuously along a circular filling path P extending clockwise (in FIG. 1) about axis 6 and between an input station 15, where containers 2 are transferred on to conveyor 7, and an output station 16 where containers 2, filled with material 3, are unloaded off conveyor 7.

System 1 also comprises a rotary input conveyor 17 for feeding containers 2 to conveyor 7 in equally spaced manner, and tangent to conveyor 7 at station 15; a rotary output conveyor 18 for withdrawing containers 2 from conveyor 7 in equally spaced manner, and tangent to conveyor 7 at station 16; and a linear conveyor 19 tangent to input conveyor 17 at a loading station 20, and to output conveyor 18 at an unloading station 21. Conveyor 19 presents an ordering device 22 comprising a screw 23 located along conveyor 19 immediately upstream from station 20 in the traveling direction 24 of containers 2. By means of an actuating device 25, screw 23 is rotated about its axis parallel to direction 24, so as to equally space containers 2 at the input of conveyor 17, which spacing equals that, about the periphery of plate 8, of a number of seats 26 for receiving respective containers 2 at station 15, feeding them along filling path P, and releasing them at output station 16. Each seat 26 comprises a base 27 integral with plate 8 and presenting an upright 28 from which arms 29 project outwards for retaining a respective container 2 in a given position on base 27.

Over seats 26, conveyor 7 supports a toroidal, open-topped vessel 30 connected to and rotating with conveyor 7 about axis 6 and containing a given quantity of powdered material 3. More specifically, and as shown in FIG. 2, vessel 30 comprises a central cup-shaped body 31 coaxial with axis 6 and presenting a bottom wall 32 connected integral with the top end of sleeve 10 projecting above the top end of shaft 5, and a lateral wall 33 in turn presenting an outer annular flange 34 perpendicular to axis 6. Vessel 30 also comprises an annular plate 35 projecting outwards and over seats 26 from an intermediate portion of sleeve 10, and of substantially the same outside diameter as plate 8; and two cylindrical walls 36 and 37, the first inside the second, and both coaxial with axis 6 and extending upwards from plate 35. More specifically, wall 36 is connected integral with plate 35 at the bottom end, and with the outer periphery of flange 34 at the top end; while wall 37 extends upwards from the outer periphery of plate 35, and presents an annular flange 38 extending outwards from an intermediate portion of wall 37 and defining the bottom wall of an annular channel 39 coaxial with axis 6 and defined laterally, on one side, by the top portion of wall 37 and, on the other side, by a cylindrical wall 40 extending upwards from the outer periphery of flange 38.

Walls 36 and 37 define, on plate 35, an annular outer peripheral portion forming the bottom wall 41 of vessel 30 which is closed at the top by a cover 42.

As shown in FIG. 1 and particularly in FIG. 2, cover 42 is fixed, is substantially circular and coaxial with axis 6, is supported on a fixed external upright 43, and comprises a circular plate 44 coaxial with axis 6 and presenting a peripheral lip 45 cooperating in fluidtight manner with a flange 46 extending inwards from a top end portion of wall 37. A tubular body 47 coaxial with axis 6 extends downwards from plate 44, and is connected in rotary manner, via the interposition of a bearing 48, to the inner surface of a tubular appendix 49 extending upwards from flange 34 and parallel to wall 33. Together with flange 34, appendix 49 defines a seat for the periphery of a filter 50 locked against flange 34 by the end of tubular body 47 so as to close body 31 which, together with filter 50, defines a filtering device 51 communicating externally via a fixed conduit 52 extending centrally through plate 44 and connected to the inlet of a suction device 53 (FIG. 1). At the top of vessel 30, plate 44 presents a conduit 54 for filling vessel 30 with material 3; and a number of sleeves 55, each fitted through with a scraper rod 56 extending parallel to axis 6 inside vessel 30 and substantially in contact with the surface of wall 36 facing wall 37.

Wall 41 presents a number of through holes 57 equal in number to seats 26, and each presenting an axis 58 coaxial with a container 2 positioned on base 27 of seat 26 and engaged by retaining arms 29. Each hole 57 forms the inlet of a respective dispenser 59 which, as shown more clearly in FIG. 3, comprises a substantially funnel-shaped, downward-tapering conduit 60 coaxial with axis 58, made of porous material, and the bottom end of which is located, in use, relatively close to the top end of inlet 2A of container 2, and defines, with inlet 2A, an annular passage 2B.

Figure 3:
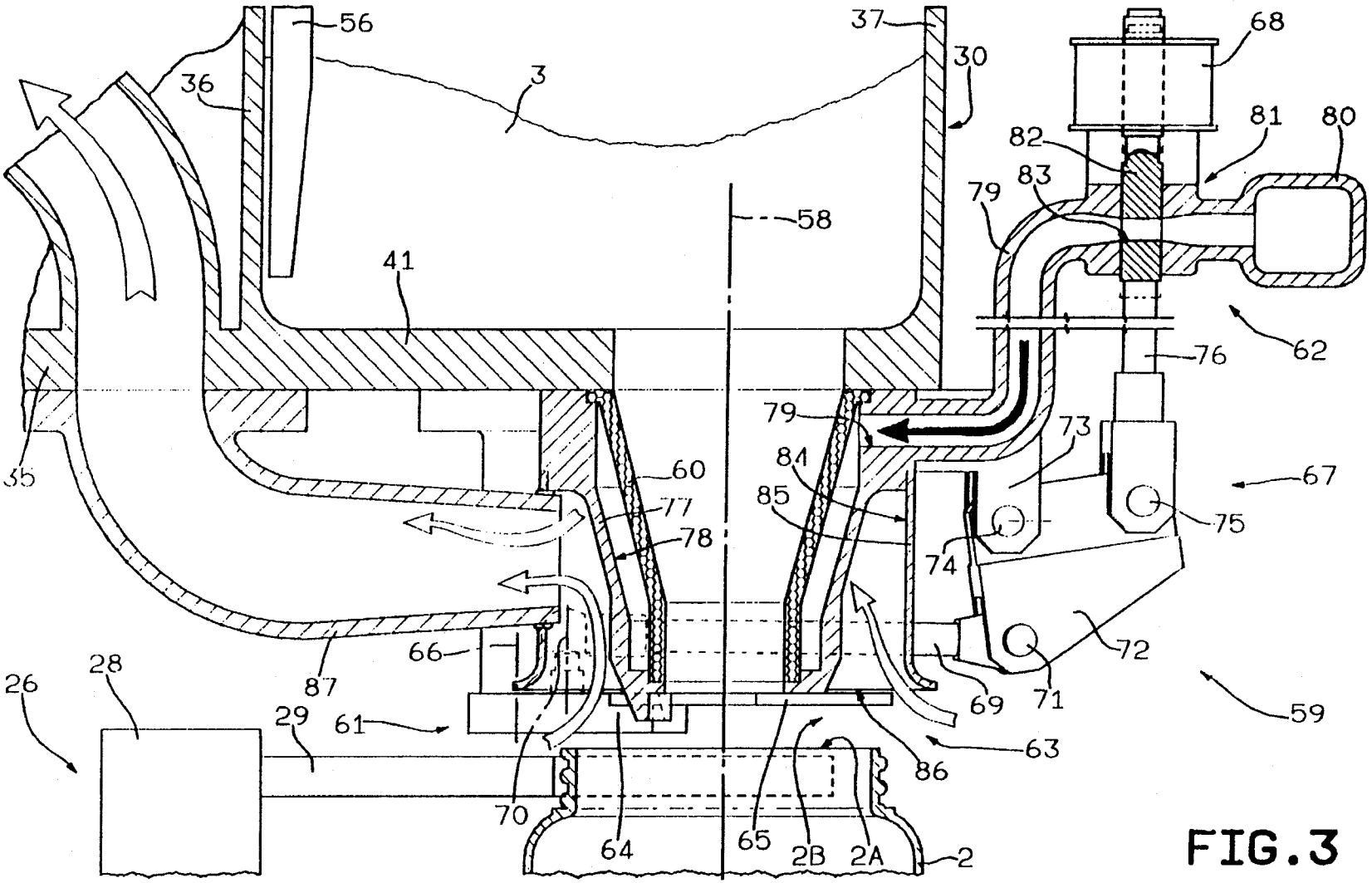
FIG. 3 shows a larger-scale view of a detail in FIG. 2.

Again with particular reference to FIG. 3, each dispenser 59 also comprises a shutter 61 movable between two positions wherein it respectively opens and closes the bottom end of conduit 60; a control device 62 for permitting free flow of material 3 along conduit 60 when shutter 61 is open; and a suction device 63 which, in use, prevents the part of material 3 issuing from conduit 60 and inevitably flowing along passage 2B from being lost to the atmosphere.

Figure 4:
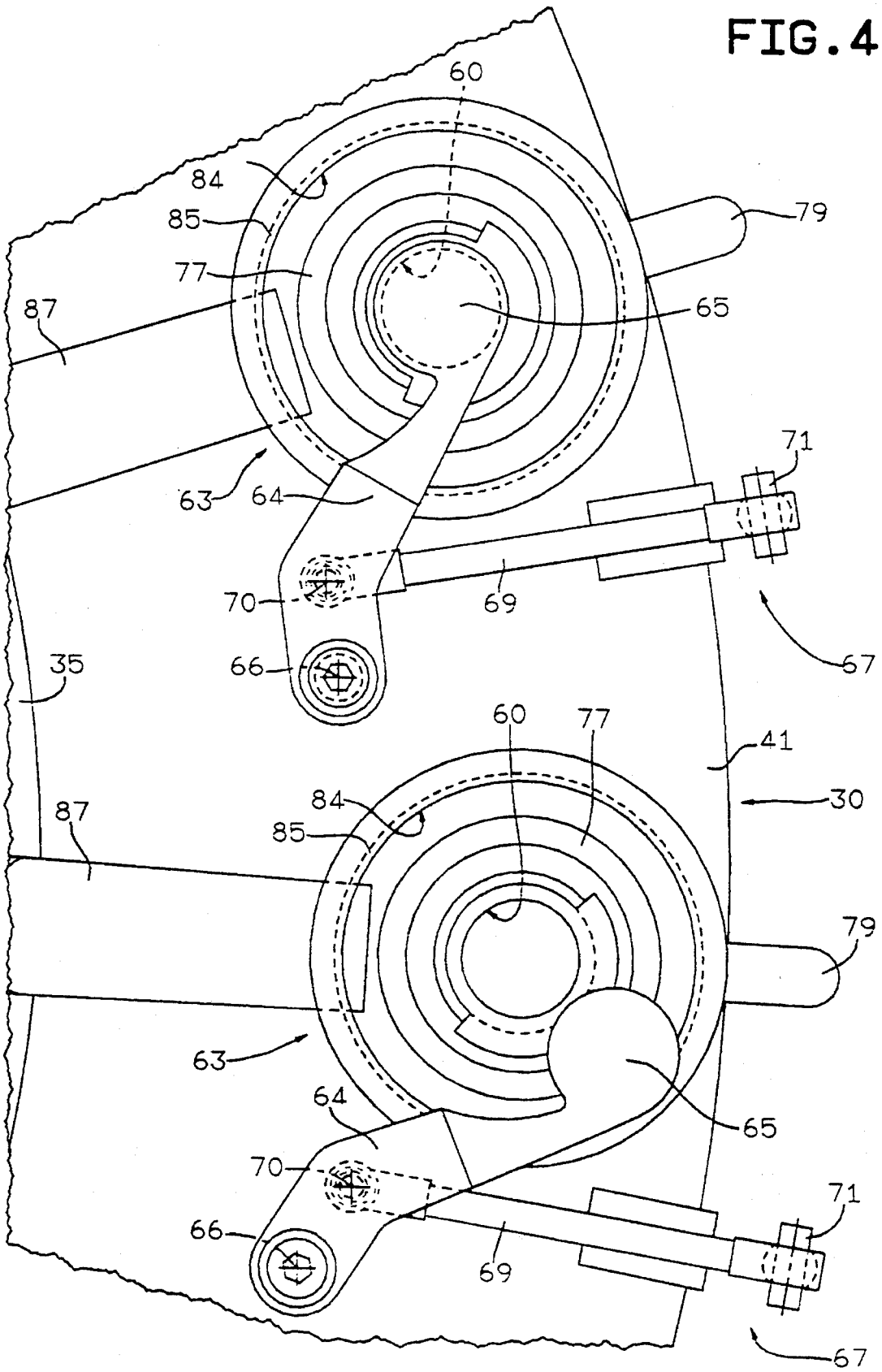
FIG. 4 shows a bottom plan view of the FIG. 3 detail.

With reference jointly to FIGS. 3 and 4, shutter 61 comprises a lever 64, one end of which is fitted with a plate 65 for closing the bottom end of respective conduit 60, and the other end of which pivots on wall 41 so as to rotate, about an axis 66 parallel to respective axis 58, between a closed and open position as shown respectively at the top and bottom of FIG. 4. Lever 64 is controlled by a drive 67 operated by an actuator 68 inside channel 39, and which comprises a drive rod 69 hinged at one end, at 70, to an intermediate point of lever 64, and at the opposite end to a pin 71 crosswise to axis 58 and fitted to one end of a square rocker arm 72 forming part of drive 67. An intermediate point of rocker arm 72 pivots on a bracket 73 integral with wall 41, so as to rotate, in relation to bracket 73, about a pin 74 parallel to pin 71; and, at the opposite end to that fitted with pin 71, rocker arm 72 is fitted with a further pin 75 parallel to pin 71 and by which rocker arm 72 is hinged to the bottom end of the output rod 76 of actuator 68.

Control device 62 comprises a tubular jacket 77 surrounding conduit 60 and defining about it an annular chamber 78 which communicates externally on one side through the porous material of conduit 60, and on the other side, via a conduit 79, with an annular manifold 80 housed inside channel 39 and communicating with a known source (not shown) of pressurized fluid. Passage of said fluid along conduit 79 is controlled by a gate valve 81 which comprises a slide 82 presenting an opening 83 selectively alignable with conduit 79, and forming a portion of rod 76.

Suction device 63 comprises an annular manifold 84 defined by a tubular body 85 which is coaxial with axis 58, extends downwards from wall 41 and outside jacket 77, and communicates externally on one side through a bottom annular opening 86 surrounding the output end of conduit 60, and on the other side with a radial conduit 87 extending through plate 35 and communicating with central body 31 of filtering device 51 through a respective hole 88 formed through wall 32 of body 31.

Carousel conveyor 7, vessel 30 with dispensers 59, and cover 42 with suction device 63 and filler conduit 54 define a dispensing unit 89 comprising a further suction device 90 for eliminating any powdered material 3 suspended at the top of vessel 30, and in turn comprising a number of conduits 91 connecting said top of vessel 30 to a number of inlets 92 of central body 31 and formed through wall 33.

In actual use, containers 2 are fed in disorderly manner along linear conveyor 19, are equally spaced by screw 23 of ordering device 22 before being fed on to conveyor 17, and are turned roughly 90° anticlockwise by conveyor 17 on to conveyor 7. Each container 2 is released by conveyor 17 on to conveyor 7 at station 15 in such a manner as to occupy a respective seat 26 where it is locked in position on respective base 27 by retaining arms 29 of seat 26. Container 2 is then fed by conveyor 7 along path P to output station 16 where it is released on to rotary conveyor 18 and fed back on to linear conveyor 19 in equally spaced manner through unloading station 21.

Unit 89 presents a known proximity sensor (not shown) at a given location immediately downstream from input station 15, and which, upon the passage of each container 2, generates a signal for enabling respective actuator 68 of respective control device 62. More specifically, upon container 2 reaching said location, the sensor (not shown) provides for moving respective rod 76 axially from a lowered idle position, wherein plate 65 of lever 64 of respective shutter 61 closes respective conduit 60, to a raised operating position wherein plate 65 of respective shutter 61 opens respective conduit 60. Moreover, slide valve 82 of rod 76 is so positioned as to open conduit 79 between annular manifold 80 and respective annular chamber 78 which is filled with pressurized fluid which flows through the porous material of respective conduit 60 to prevent material 3 from clinging to the inner surface of conduit 60 and so assisting the formation, along conduit 60, of bridge structures of material 3 capable of cutting off the flow of material 3 along conduit 60.

Most of the material 3 issuing from conduit 60 penetrates inside container 2 through inlet 2A, while a small proportion flows along passage 2B and would be lost to the atmosphere if, by virtue of the vacuum generated by suction device 53 on cover 42, it were not immediately aspirated by suction device 63, through annular opening 86 of tubular body 85, and separated by filter 50. Similarly, the cloud of material 3 and air formed at the top of toroidal vessel 30, when material 3 is loaded along conduit 54, is aspirated along conduits 91 of suction device 90 and fed into body 31 where it is treated in the same way as the material 3 flowing along passage 2B.

Control device 62 presents a known timer (not shown) which, after a given time interval, disables actuator 68 of control device 62 relative to container 2, so as to move respective rod 76 axially downwards so that respective plate 65 is positioned closing conduit 60; at which point, retaining arms 29 release container 2 which is fed on to output conveyor 18 at station 16.

We claim:

1. A powdered material gravity dispensing unit for filling containers, the unit comprising a vessel for powdered material, and at least one dispenser connected to the bottom end of the vessel to permit measured quantities of said material to be withdrawn by gravity from the vessel; the dispenser comprising a supply conduit communicating with the vessel, and a device for selectively closing the supply conduit comprising a shutter, and drive means for moving the shutter to and from a position wherein it closes the supply conduit; wherein the supply conduit is made of porous material; the dispenser comprising a pneumatic circuit for feeding pressurized pneumatic fluid into contact with the outer surface of the supply conduit comprising a pneumatic conduit, and valve means for controlling said pneumatic conduit, and suction means adjacent to the output end of the supply conduit; wherein said drive means comprises an actuator presenting a movable output element connected both to the shutter and to said valve means, for simultaneously opening and closing said supply conduit and said pneumatic conduit.

2. A unit as claimed in claim 1, wherein said pneumatic circuit further comprises an annular chamber for receiving said pressurized pneumatic fluid and the supply conduit extends in a fluidtight manner through the annular chamber.

3. A unit as claimed in claim 1, wherein said suction means comprises an annular intake manifold surrounding the supply conduit and presenting an annular, downward-facing inlet.

4. A unit as claimed in claim 1, which further comprises a carousel conveyor rotating about a vertical axis; the vessel forming part of said carousel conveyor, being toroidal and coaxial with said axis, rotating about said axis, and presenting, underneath, a number of said dispensers.

5. A unit as claimed in claim 4, wherein said carousel conveyor further comprises a fixed cover closing said toroidal vessel and fixed agitating means extending from said cover into said vessel.

6. A unit as claimed in claim 4, which further comprises a suction chamber presenting a number of inlets and at least one external outlet; said suction means of each said dispenser communicating with a respective said inlet; and filtering means housed inside said suction chamber, for separating said inlets from said outlet.

7. A unit as claimed in claim 6, wherein said suction chamber comprises a further number of inlets and further suction means connecting said further number of inlets to the top portion of said vessel.

8. A powdered material gravity dispensing unit for filling containers, the unit comprising a vessel for powdered material, and at least one dispenser connected to the bottom end of the vessel to permit measured quantities of said material to be withdrawn by gravity from the vessel; wherein the dispenser comprises a supply conduit communicating with the vessel and made of porous material, a pneumatic circuit for feeding pressurized pneumatic fluid into contact with the outer surface of the supply conduit, and pneumatic anti-pollution means surrounding the supply conduit for preventing the powdered material from escaping into the atmosphere when said containers are being filled, said anti-pollution means comprising a suction chamber having at lest one inlet, at least one outlet and filtering means in said suction chamber separating said inlet and said outlet.

9. A unit as claimed in claim 8, wherein said supply conduit comprises an output end, and said anti-pollution means comprises an annular intake manifold surrounding said output end of said supply conduit and an annular downward-facing inlet.

* * * * *

UNITED STATES PATENT AND TRADEMARK OFFICE

CERTIFICATE OF CORRECTION

PATENT NO. : 5,598,876

DATED : February 4, 1997

INVENTOR(S) : G. Zanini et al.

It is certified that error appears in the above-indentified patent and that said Letters Patent is hereby corrected as shown below:

| COLUMN | LINE | |
|---|---|---|
| 6 (Claim 8, | 20 line 13) | "at lest" should read --at least-- |

Signed and Sealed this

Seventeenth Day of June, 1997

Bruce Lehman

*Attest:*

BRUCE LEHMAN

*Attesting Officer*

*Commissioner of Patents and Trademarks*